US010164352B2

(12) United States Patent
Dendas et al.

(10) Patent No.: US 10,164,352 B2
(45) Date of Patent: Dec. 25, 2018

(54) RESILIENT BUSHING AND CONNECTOR COMPRISING SAME

(71) Applicant: TYCO ELECTRONICS NEDERLAND BV, AR ' s-Hertogenbosch (NE)

(72) Inventors: Freddy Jean Philip Dendas, Genk (BE); Sebastiaan Roger Neerincx, Tilburg (NL); Tekke Drijfhout, Nistelrode (NL)

(73) Assignee: TE Connectivity Nederland BV, S'Hertogenbosch (NL)

( * ) Notice: Subject to any disclaimer, the term of this patent is extended or adjusted under 35 U.S.C. 154(b) by 0 days.

(21) Appl. No.: 13/720,670

(22) Filed: Dec. 19, 2012

(65) Prior Publication Data

US 2013/0164979 A1 Jun. 27, 2013

(30) Foreign Application Priority Data

Dec. 22, 2011 (EP) ..... 11195118

(51) Int. Cl.
*H01R 9/05* (2006.01)
*H01R 13/59* (2006.01)
*H01R 9/03* (2006.01)

(52) U.S. Cl.
CPC ..... *H01R 9/0527* (2013.01); *H01R 13/59* (2013.01); *H01R 9/032* (2013.01)

(58) Field of Classification Search
CPC ..... H01R 9/0518; H01R 13/59; H01R 9/032
USPC ..... 439/607.41, 607.44, 607.5, 939, 607.01, 439/578–595
See application file for complete search history.

(56) References Cited

U.S. PATENT DOCUMENTS 3,581,269 A * 5/1971 Frey et al. ..... 439/584
3,622,952 A 11/1971 Hilbert
3,781,762 A * 12/1973 Quackenbush ..... 439/322
(Continued)

FOREIGN PATENT DOCUMENTS

CN 101771202 A 7/2010
EP 2 202 852 A2 6/2010
(Continued)

OTHER PUBLICATIONS

Search Report issued by the European Patent Office, The Hague, dated May 29, 2012, for related European Application No. EP 11195118.2; 6 pages.
(Continued)

*Primary Examiner* — Harshad C Patel
(74) *Attorney, Agent, or Firm* — Faegre Baker Daniels LLP

(57) ABSTRACT

The present invention relates to a bushing for contacting a braid of a line within a connector, the bushing is essentially tapering in an insertion direction in which the bushing is adapted to be inserted into the braid in order to be encompassed thereby. Further, the invention relates to a connector comprising a bushing. In order to provide a bushing which allows for being inserted into the braid in a gentle manner and at the same time allows the braid to be evenly contacted with the bushing for establishing a reliable mechanical and/or electrical connection therewith, the present invention provides that the bushing has a radial elasticity allowing a spring tensioned widening and/or compression of the bushing.

29 Claims, 6 Drawing Sheets

(56) References Cited

U.S. PATENT DOCUMENTS

| | | | | |
|---|---|---|---|---|
| 4,150,865 | A | 4/1979 | Iliff | |
| 4,421,377 | A * | 12/1983 | Spinner | 439/583 |
| 4,619,332 | A * | 10/1986 | Sheehan | H02G 3/0691 174/659 |
| 4,963,104 | A | 10/1990 | Dickie | |
| 6,642,451 | B1 * | 11/2003 | Gretz | F16L 33/227 16/2.1 |
| 7,125,283 | B1 * | 10/2006 | Lin | 439/578 |
| 7,479,033 | B1 * | 1/2009 | Sykes et al. | 439/578 |
| 7,714,229 | B2 * | 5/2010 | Burris et al. | 174/75 C |
| 7,723,623 | B2 * | 5/2010 | Kiely | F16L 5/00 174/650 |
| 7,845,978 | B1 * | 12/2010 | Chen | 439/578 |
| 7,942,699 | B1 | 5/2011 | Rossman et al. | |
| 7,952,034 | B2 * | 5/2011 | Kiely | H02G 3/0683 174/650 |
| 2003/0089517 | A1 * | 5/2003 | Takahashi | H01R 9/0518 174/78 |
| 2012/0088403 | A1 * | 4/2012 | Yokoyama | H01R 9/0518 439/582 |

FOREIGN PATENT DOCUMENTS

| | | | |
|---|---|---|---|
| EP | 2214265 | A1 | 8/2010 |
| EP | 2302431 | A1 | 3/2011 |
| EP | 2354825 | A1 | 8/2011 |
| FR | 2075570 | A5 | 10/1971 |
| GB | 2312341 | A | 10/1997 |

OTHER PUBLICATIONS

English translation of Office Action issued by the State Intellectual Propeerty Office of the People's Republic of China, dated Jan. 14, 2016, for Chinese Application No. 201210564665.6; 10 pages.

* cited by examiner

RESILIENT BUSHING AND CONNECTOR COMPRISING SAME

BACKGROUND OF THE DISCLOSURE

The present invention relates to a bushing for contacting an armour or braid of a cable or line within a connector, the bushing is essentially tapering in an insertion direction in which the bushing is adapted to be inserted into the armour or braid in order to be encompassed thereby. Further, the invention relates to an electrical connector.

Full reference is made to the complete disclosure of European patent applications EP 09 012 270, EP 10 001 103 and EP 11 183 866 with respect to an enclosure assembly for at least one of a variety of in particular standardized connectors on a cable, as well as to the components, advantages and various embodiments and features of said enclosure assembly. All three applications are herewith incorporated by reference.

SUMMARY OF THE DISCLOSURE

In the following, for the sake of simplicity, the term line is generally used for any cables, electrical lines and/or optical fibres and alike. The term braid is generally used for any kind of braid, shielding, armour and/or reinforcement structure and alike of said line. The term connector is generally used for all connectors, plugs and/or plug elements, including but not limited to electrical and/or optical connectors, The direction "forward" is defined for the bushing as facing in the direction of a mating connector, which is to be mated by the connector comprising the bushing, or for the end of the line, onto which the bushing is to be slid. Hence, the direction "rearward" designates the opposite direction, i.e. a direction facing away from a mating connector of the end of the line. If the bushing is mounted or being mounted onto a line, the forward and rearward direction are running essentially in parallel to the line.

Bushings for contacting braids of lines within connectors, as mentioned in the beginning of the description, are known from the prior art. For example, document U.S. Pat. No. 4,150,865 describes tapered ferrules provided for press-fitting a shielding braid by being plugged into the braid while surrounding an isolated electrical conductor of the line. Moreover, document U.S. Pat. No. 4,963,104 describes a solid bushing having an inner diameter sufficiently large to fit over a bundle of wires which is to be inserted into a braided metallic shielding enclosing the wires.

Disadvantages arising from the bushings known from the prior art, e.g. those described in documents U.S. Pat. No. 4,963,104 or U.S. Pat. No. 4,150,865 mentioned above, are that the braid of the line may be not be satisfyingly and evenly contacted in a mechanically reliable and/or electrically conductive manner, since it is prone to fold, crinkle and even rip or crumble while the bushing is inserted into the braid or afterwards during further handling.

Consequently, it is an object of the present invention to provide a bushing which allows for being inserted into the braid in a gentle manner and at the same time allows the braid to be evenly contacted with the bushing in order to establish a reliable electrical and/or mechanical connection therewith.

This object is achieved according to the present invention for the bushing mentioned in the beginning of the description, in that the bushing has a radial elasticity allowing a spring tensioned widening and/or compression of the bushing.

For the electrical connector mentioned in the beginning of the description, the object is achieved in that it comprises at least one bushing according to the present invention.

This solution allows for that the bushing may be inserted into the braid while having a reduced circumference, since the radial elasticity allows for radially compressing the bushing during insertion. Afterwards, the bushing may be decompressed, such that it assumes or at least desires to assume its initial uncompressed state, thereby snugly fitting into the braid, which is thus gently tensioned or even widened without folding or ripping. This procedure is further advantageous in that a continuous shielding, i.e. braid termination, may be achieved without tools. Hence, the present invention improves the stability and field mountability of a connector comprising an inventive bushing.

In the following, further improvements of the bushing and the connector according to the invention are described. These additional improvements may be combined independently of each other, depending on whether a particular advantage of a particular improvement is needed in a specific application.

According to a first advantageous improvement, the bushing is provided with at least one slit extending along the insertion direction. Thereby, the spring characteristics of the bushing may be enhanced in addition to providing the bushing with a radial elasticity, as mentioned above, e.g. by optimizing the material thickness of the bushing and the material itself.

The spring characteristics may be further improved in that the slit may extend along an entire length of the bushing in the insertion direction. This allows for compressing the entire bushing while being inserted into the braid in the rearward direction. Further, the slit extending along the entire length of the bushing allows for evenly distributed spring characteristics along the length of the bushing for a gentle circumferential contact with the braid.

At least one protrusion and at least one recess accommodating the protrusion may be formed at the at least one slit and may extend along a circumferential direction of the bushing. The edges of the bushing at the slit may mesh or interleave along its length. Hence, along the entire length and/or circumference of the bushing, spring forces may be evenly exerted onto the braid. In other words, especially in a projection along the insertion direction, the formation of a gap within the wall of the braid is prevented, which again improves a gentle insertion of the bushing into the braid.

Gently exerting a spring force onto the inner circumference of the braid by the outer circumference of the bushing may be further improved in that several protrusions and recesses opposing and/or complementing each other are formed along the at least one slit. In other words, the at least one slit may at least in sections have a meandering shape.

The spring characteristics of the bushing may be further improved in that a tip of the bushing facing into the insertion direction comprises at least one notch extending essentially in parallel to the insertion direction. The at least one notch, in addition to the slit, may allow for improved spring characteristics especially at the tip, i.e. the tapered end of the bushing, which is to be inserted into the braid first.

The spring characteristics, especially of a rear end, i.e. the tip of the bushing, facing into the rearward direction, may be further improved in that at least one end of the bushing is formed as several tongues extending essentially in parallel to the insertion direction. Between each of these tongues, at least one notch mentioned above may be formed. The tongues may be arranged radially around a longitudinal axis of the bushing in a projection along the longitudinal axis, which extends essentially in parallel to the insertion direction. Thereby, the spring characteristics of the at least one end, i.e. the rear end, may be improved.

The bushing may comprise a cylindrical portion and a conical portion. The cylindrical portion may improve an even and gentle contact with the braid under a specific outer diameter of the braid, while the conical portion may facilitate an insertion of the bushing into the braid and may provide the tapering of the bushing. Alternatively and/or in addition, the bushing, its cylindrical portion and/or conical portion may have an oval and not necessarily circular cross-section. In other words, the bushing may have any kind of sections with at least partly annular cross-sections which may have a tapering or beveled shape along the insertion direction, especially towards a tip or end of the bushing adapted to be inserted into the braid first.

The spring characteristics of the bushing may be improved while optimizing its electrical characteristics in that the bushing may be formed of a resilient metal or metal alloy. Thereby, the respective desired electrical and spring characteristics of the bushing may be achieved. The bushing may be easily manufactured in that it may be integrally formed of stamped sheet material.

Within a connector, a bushing according to the invention may be in a radially compressed state, wherein a diameter of the bushing is reduced in comparison with an uncompressed state of the bushing. Thus, the bushing may be constantly exerting a spring force onto an inner diameter within the connector or a line accommodated within that connector. The bushing may be inserted into, and in a radial direction of the connector overlap with, at least one of a braid of a line and/or a shielding structure of the connector or a connector assembly.

The braid may be easily fixed in relation to the bushing in that the connector may further comprise or may be provided with a ferrule which surrounds the bushing. In other words, the ferrule may be slid onto the bushing in the forward direction after the bushing has been inserted to the braid. Hence, the braid may be encompassed and/or enclosed by the ferrule such that it is immobilized between the ferrule and the bushing.

Moreover, a kit for a line termination or a kit for a connector may comprise a bushing according to the present invention. The kit may thereby serve for terminating a cable or line on site and/or within a connector. This also allows for easily using the bushing within a connector, especially a connector within a closure assembly mentioned above.

In the following, the invention and its improvements are described in greater details using exemplary embodiments thereof and with reference to the drawings. As described above, the various features shown in the embodiments may be used independently of each other according to the respective requirements of specific applications.

DETAILED DESCRIPTION OF THE DRAWINGS

Figure 1:
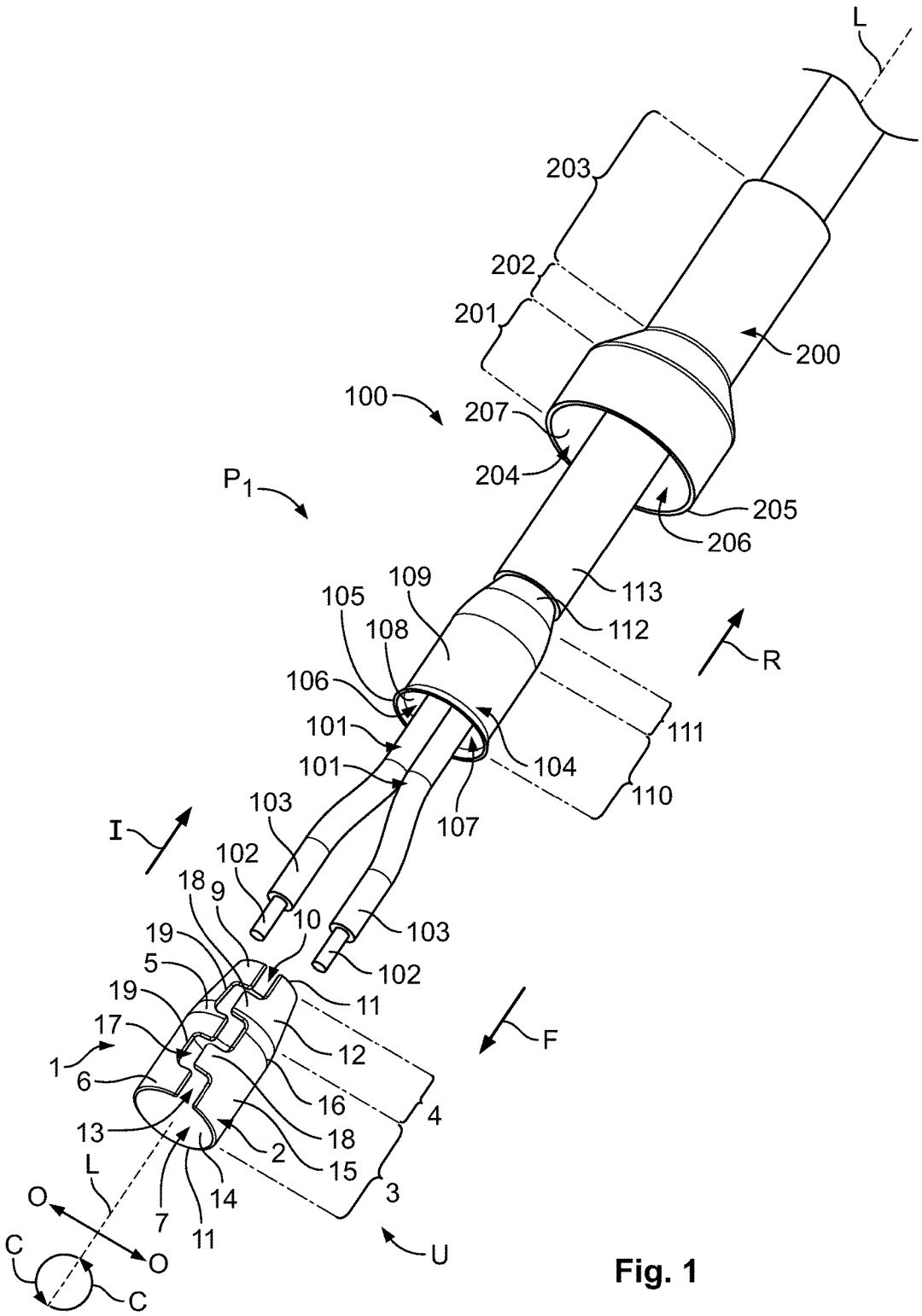
FIG. 1 is a schematic perspective view of a bushing according to the present invention ready to be applied to a line.

FIG. 1 shows a bushing 1 according to an embodiment of the present invention ready to be applied to a line 100 in a first pre-assembled state P1. The bushing 1 has a body 2 having a cylindrical portion 3 and a conical portion 4. The cylindrical portion 3 merges with the conical portion 4 at a transition region 5 of the bushing 1. The cylindrical portion 3 extends from the transition region 5 to a forward end of the bushing 1 facing into a forward direction F, in which the bushing 1 faces a mating connector (not shown). The forward end 6 provides a forward opening 7 of the bushing 1. The forward opening 7 is surrounded by an essentially annular forward edge 8 of the bushing 1.

The cylindrical portion 3 extends from the transition region 5 to a rearward end 9 of the bushing 1. The rearward end 9 provides a rearward opening 10 of the bushing 1. The rearward end 9 is surrounded by a rearward edge 11 of the bushing 1. From the transition region 5 towards the rearward edge 11, the bushing 1 is tapered, such that a tip 12 of the bushing 1 is formed. The rearward end 9 providing the tip 12 faces into an insertion direction I of the bushing 1, the insertion direction I running essentially in parallel to a rearward direction R, in which the bushing is supposed to be mated with the line 100.

Via the forward opening 7 and the rearward opening 10 an interior space 13 of the bushing 1 is accessible. The interior space 13 is circumferentially bordered by an inner circumference 14 of the bushing. A longitudinal axis L extends concentrically through the interior space 13. In other words, the inner circumference 14 radially surrounds the longitudinal axis L in a radial direction O. On the outside of the body 2, a wall 15 of the bushing 1 forms its outer circumference 16, which also extends essentially radially around the longitudinal axis L.

A slit 17 is formed in the wall 15 and extends generally along the longitudinal axis L. The slit 17 has a meandering shape in that it is provided with several protrusions 18 and recesses 19, both extending essentially along a circumferential direction C of the bushing 1, the circumferential direction C concentrically extending around the longitudinal axis L and being defined by the inner and outer circumference 14, 16, respectively, of the bushing 1. In an uncompressed state U of the bushing 1 shown in FIG. 1, the bushing 1 is to be compressed such that its diameter DU in the uncompressed state U may be reduced to a reduced diameter DV in a compressed state V of the bushing 1, which is explained further below.

The line 100 comprises two strands 101. The stands 101 may be or comprise any kind of electrical conductor, optical fibre or bundle of optical fibres. In the present exemplary embodiment, the strands 101 each comprise an electrical conductor 102 which is surrounded by an inner electrical insulation 103, e.g. electrical insulation and/or sheath of the line. A braid 104 of the line 100 circumferentially surrounds the strands 100. The braid 104 may be formed of a metallic web and/or foil comprising a metal structure providing a proper shielding of the strands 101. Alternatively and/or in addition, the braid 104 may be and/or comprise an armour and/or reinforcement structure. The braid 104 has a seam or fringe 105 where the braid 104 has been cut. The fringe 105 borders a braid opening 106 towards a braid interior 107 defining an inner circumference 108 of the braid 104.

An outer circumference 109 of the braid 104 has different diameters, such that the braid 104 has a widened section 110, a transition section 111 and a tight section 112. The widened section 110 with the braid opening 106 faces into the forward direction F and against the insertion direction I. A diameter D110 of the widened section 110 is bigger than a diameter D112 of the tight section 112. The tight section 112 essentially has a diameter with which the braid 104 extends through an outer insulation 113 of the line 100. In other words, the tight section 112 of the braid 104 has a diameter D112 which essentially corresponds with an original diameter of the braid 104 at the time of manufacturing the line 100.

Further, a ferrule 200 is provided. The ferrule 200 is slid over the line 100, in particular over the outer insulation 113 of the line 100. The ferrule 200 comprises a collar portion 201, a tapered portion 202 and a narrow portion 203. The collar portion 201 merges with the narrow portion 203 via the tapered portion 202. The collar portion 201 has a diameter D201 which is bigger than a diameter D203 of the narrow portion. The collar portion 201 defines a front opening 204 of the ferrule 200. The front opening 204 is bordered by a front edge 205. Through the front opening 204, a receptacle 206 provided within the collar 201 is formed. The receptacle 206 has an inner circumference 207. In other words, the interior space of the ferrule 200 at the collar 201 forms a receptacle 206 with an inner circumference 207.

Figure 2:
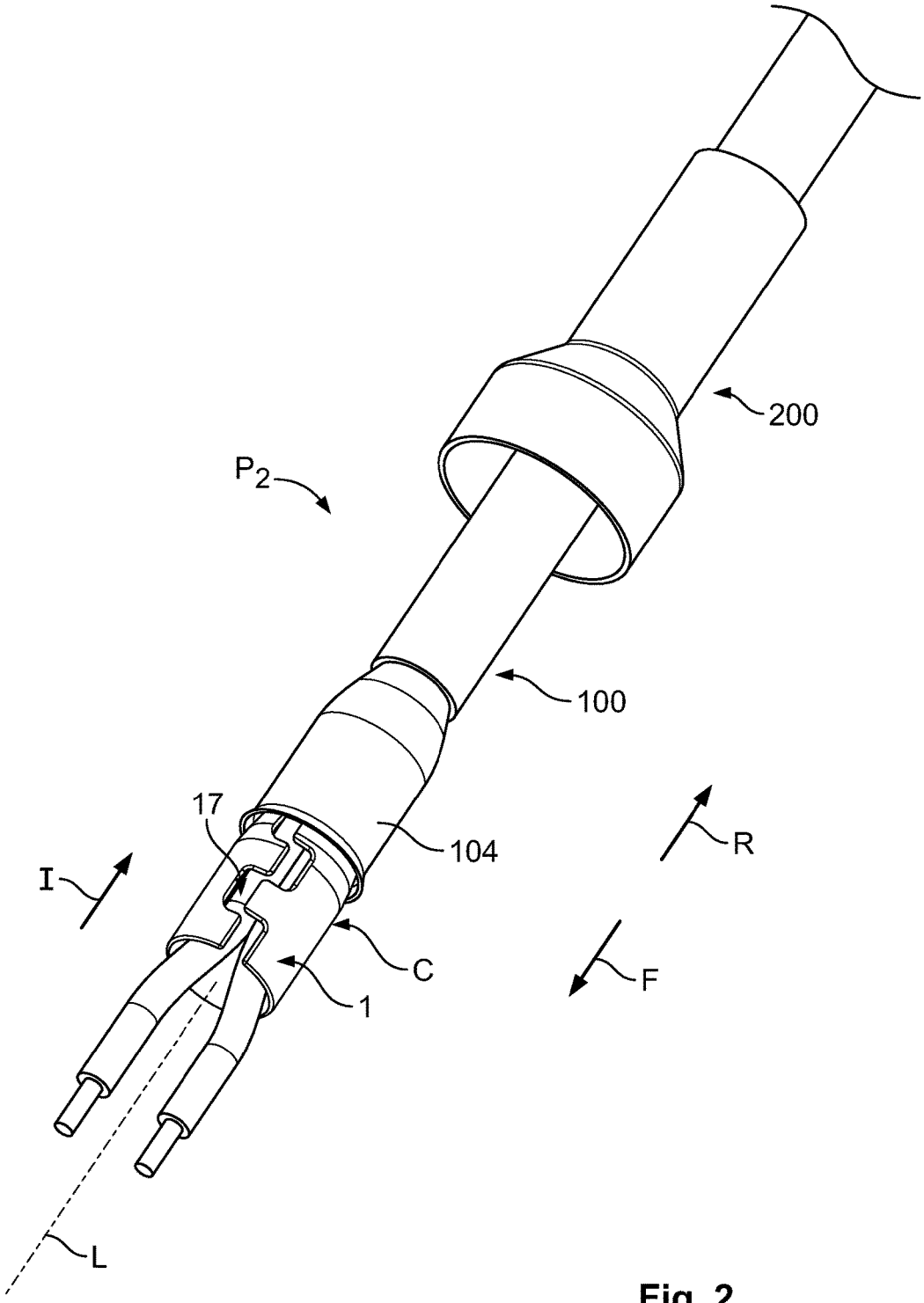
FIG. 2 is a schematic perspective view of the bushing applied to the line shown in FIG. 1.

FIG. 2 is a schematic perspective view of the bushing 1, the line 100 and the ferrule 200 in a second pre-assembled state P2. In the second pre-assembled state P2, the ferrule 200 is half-way inserted into the widened section 110 of the braid 104, i.e. into the braid interior 107. Therefore, the bushing 1 has been slid over the ends of the strands 101 facing into the forward direction F in the insertion direction I, i.e. in the rearward direction R. The bushing now is in a compressed state V wherein its diameter, circumference as well as the width of the slit 17 are reduced with respect to the uncompressed state U.

Figure 3:
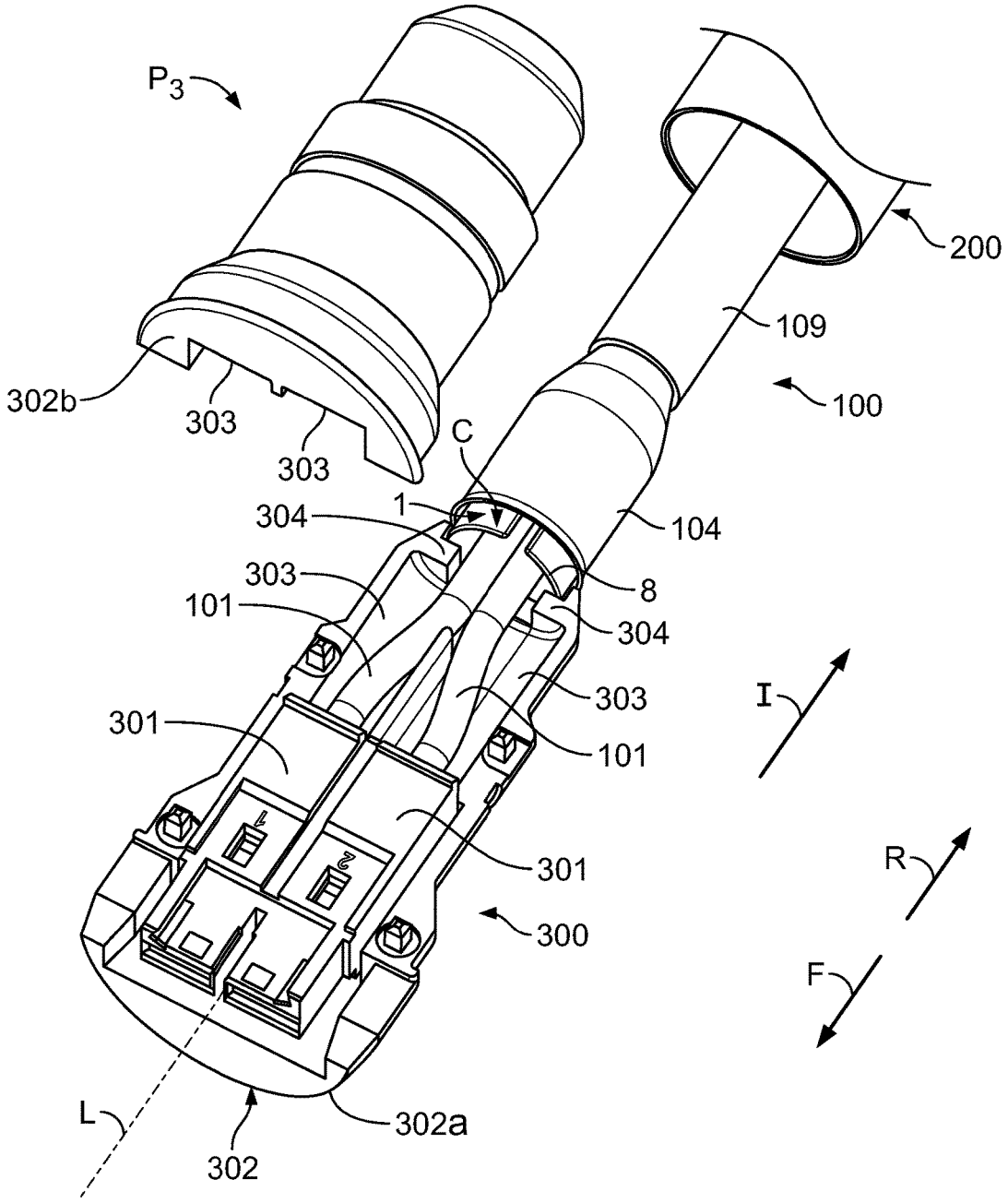
FIG. 3 is a schematic perspective view of the bushing and the line shown in FIGS. 1 and 2 used in connection with an electrical connector.

FIG. 3 is a schematic perspective view of a third pre-assembled state P3, wherein the bushing 1 is fully inserted into the braid 104 and a connector 300 is being attached to the line 100. The connector 300 may be e.g. any kind of non-standardized or standardized connector, which may be a RJ45, HSIO, AMPMODU, HDMI or any other standardized or non-standardized electrical and/or optical connector. In the present exemplary embodiment, the connector 300 comprises two terminals 301, which are each affixed to one of the strands 101, respectively, of the line 100. The terminals 301 are attached to a housing 302 of the connector 300, in particular to a first housing part 302*a* of the housing 302. The first housing part 302*a* is adapted to be complemented by a second housing part 302*b*.

The terminals 301 are each held in respective terminal holders 303 within the housing 302, such that they are non-relocatable in the forward direction F and the rearward direction R. At their ends facing in the rearward direction R, a stop 304 is formed at each of the holders 303. The forward edge 8 of the bushing 1 abuts at least one of the stops 304 such that the bushing 1 is non-relocatably held within the braid interior 107. Thus, the bushing 1, in the third pre-assembled state P3 shown in FIG. 3 is maximally inserted into the braid 104. The bushing remains in the compressed state and radially exerts a spring force with its outer circumference 16 onto the inner circumference 108 of the braid, which is thereby radially tensioned.

Figure 4:
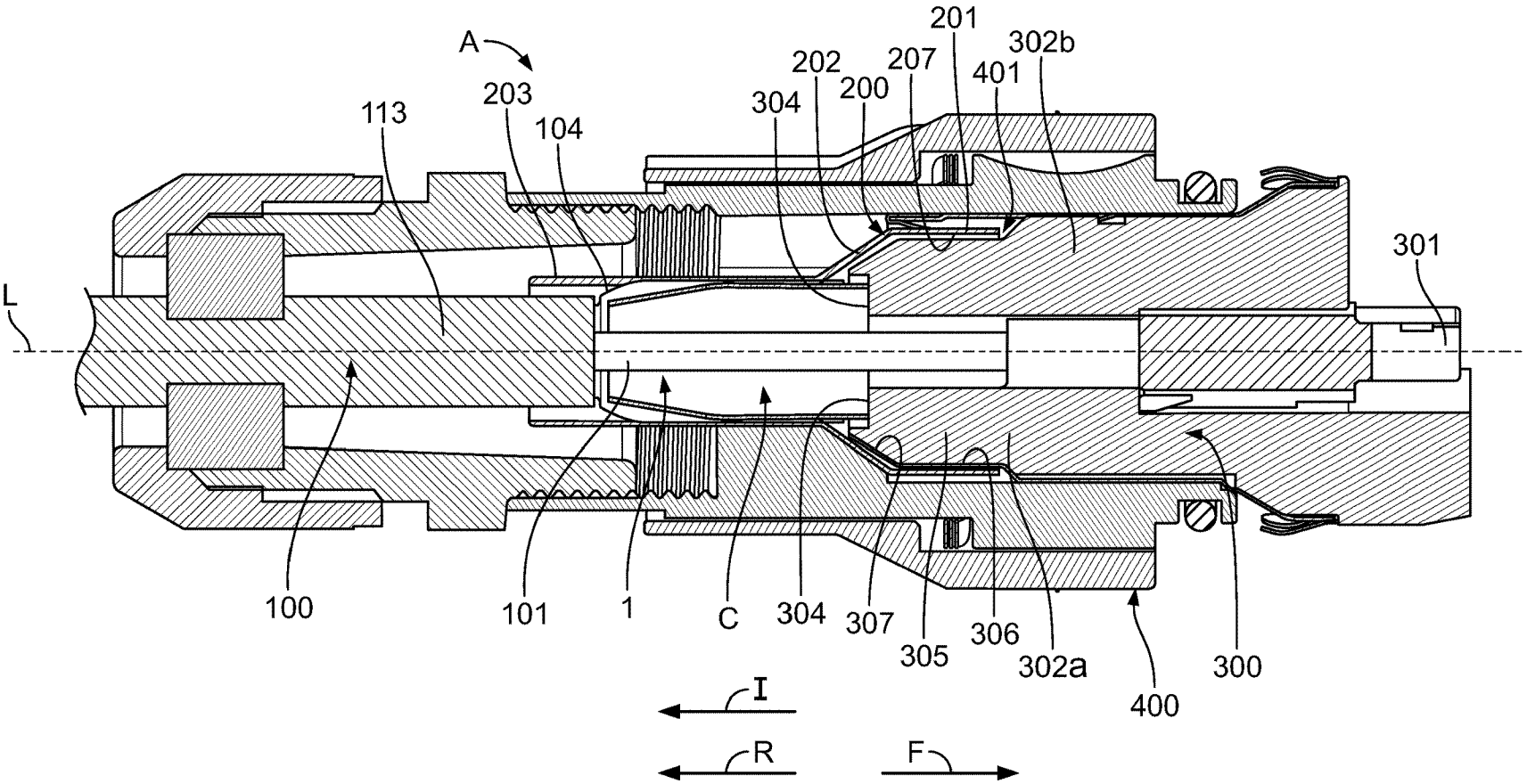
FIG. 4 is a schematic cross-sectional view of the bushing, the line and the connector shown in FIG. 3 arranged within an enclosure assembly.

FIG. 4 shows the bushing 1, the line 100, the ferrule 200, the connector 300 and an enclosure assembly 400 in an assembled state A. In the assembled state A, the connector 300 is inserted into a connector volume 401 provided within the enclosure assembly 400. The collar 201 of the ferrule 200 encompasses a neck 305 of the connector 300. In particular, the inner circumference 207 of the ferrule 200 at the collar 201 encloses an outer circumference 306 of the collar 305. A bevel 307 formed at the end of the neck 305 facing into the rearward direction is enclosed by the tapered portion 202 of the ferrule 200.

The bushing 1 is snugly fitted into the braid 104 and in the forward direction F abuts the stop 304. The braid 104 is encompassed by the narrow portion 203 of the ferrule 200. The narrow portion 203 extends in the rearward direction R such that it overlaps with the outer insulation 113 of the line 100. Hence, the braid 104 is circumferentially sandwiched between the bushing 1 and the narrow portion 203 of the ferrule 200.

Figure 5:
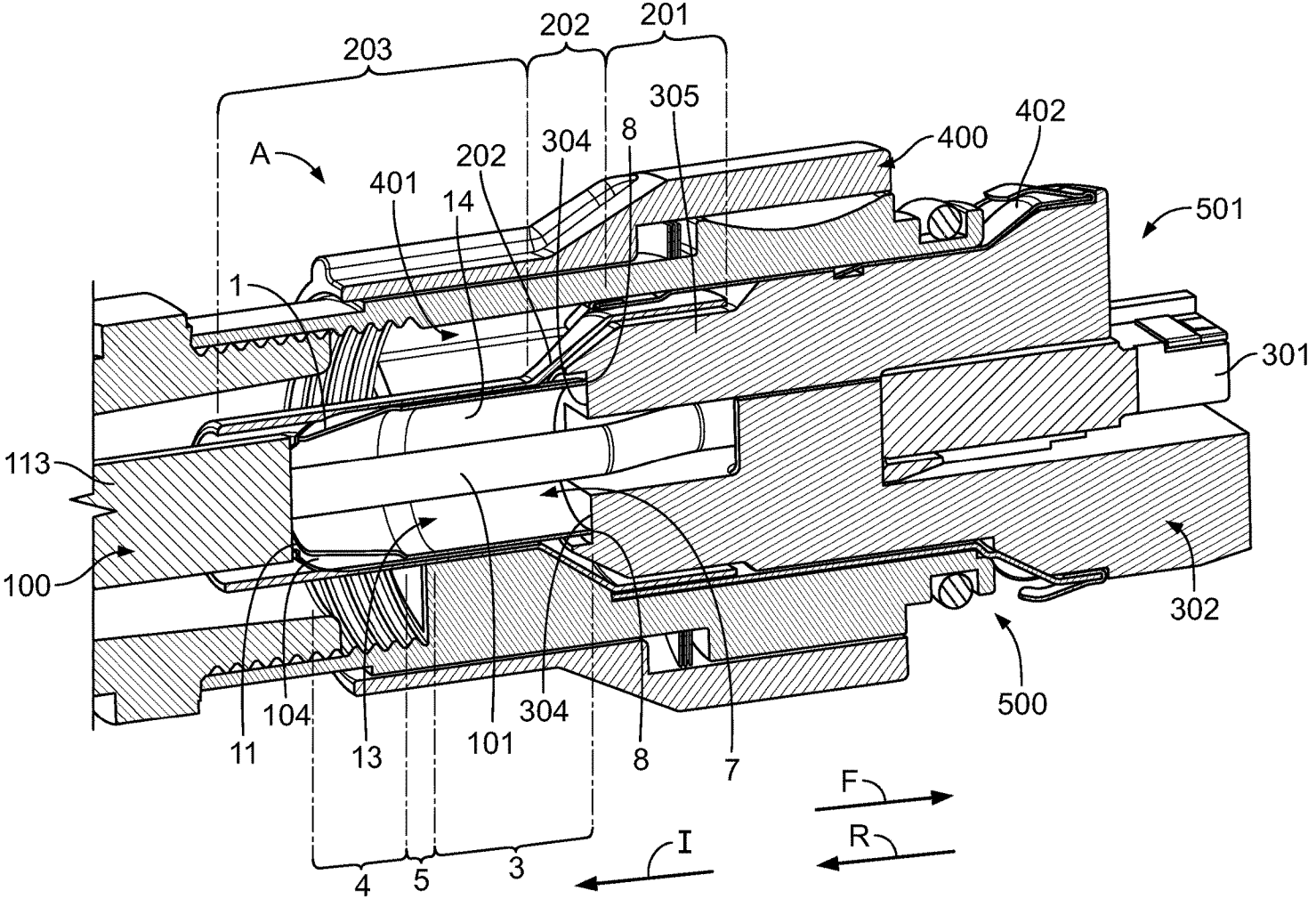
FIG. 5 is a schematic cross-sectional view of a connector assembly comprising the enclosure assembly, the bushing, the line and the connector shown in FIG. 4.

FIG. 5 shows the bushing 1, the line 100, the ferrule 200, the connector 300 and the enclosure assembly 400 in the assembled state A. Here it becomes apparent that the ferrule 200, in particular mainly the narrow portion 203 of the ferrule 200, completely radially encloses the bushing 1. Especially in the area of the cylindrical portion of the bushing 1, the narrow portion 203 tightly surrounds the bushing 1, such that the braid 104 is affixed therebetween. In the area of its tapered portion 202, the ferrule 200 encompasses the bevel 307 formed at the housing 302 of the connector 300. With its collar 201, the ferrule 200 encompasses the neck 305 of the connector 300. Hence, a positive fit is generated between the ferrule 200 and the bushing 1 as well as between the ferrule 200 and the connector 300.

At the same time, the ferrule 200 overlaps with the outer insulation 113 of the electrical line 100, with the bushing 1 as well as with the connector 300. Hence, the bushing 1 is securely held within the ferrule 200. Moreover, with its forward edge 8, the bushing 1 is supported at the stop 304 provided at the housing 300. Between the ferrule 200 and the bushing 1, the braid 104 is sandwiched and/or jammed such that it is immobilized in the form-fit, i.e. positive fit, and/or force-fit manner.

The strands 101 are continuously protected against mechanical and/or electromagnetic influences in that they are surrounded by a shielding throughout a connector assembly 500 comprising the bushing 1, the line 100, the ferrule 200, the connector 300 and the enclosure assembly 400. Therefore, in the area of the housing 302, the connector 300 is surrounded by a shielding structure 402 of the enclosure assembly 400. The shielding structure 402 is open in the forward direction F such that a mating connector assembly (not shown) may be mated with the connector assembly 500, in particular by engaging with a plug face 501 of the connector assembly 500 in a complementary manner.

FIGS. 6*a* to 6*d* show different embodiments of a bushing 1, 1', 1" and 1'", respectively, each according to an embodiment of the present invention. The bushings 1 and 1' shown in FIGS. 6*a* and 6*b*, respectively, both have a meandering slit 17 as explained above. In each case, the slit is bordered by protrusions 18 and recesses 19, complementing each other. In contrast to that, slits 17', formed in the bushings 1", 1''' shown in FIGS. 6*c* and 6*d*, respectively, are extending straight-line from the forward end 6 to the rearward end 9 of the bushings 1" and 1'''.

Figure 6D:
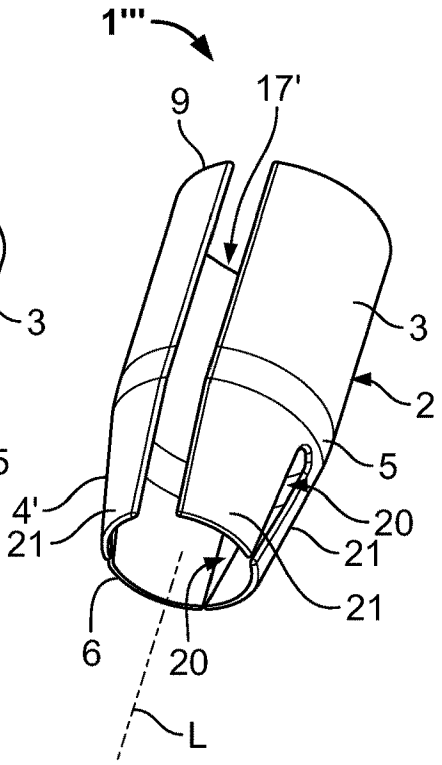
FIG. 6*d* is a schematic perspective view of another embodiment of a bushing according to the present invention.
Figure 6C:
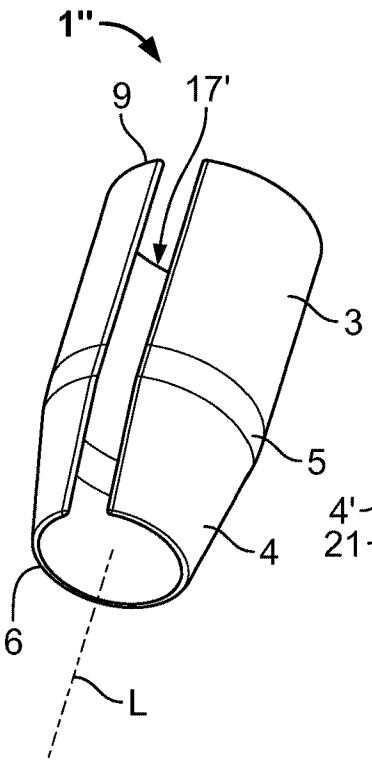
FIG. 6*c* is a schematic perspective view of another embodiment of a bushing according to the present invention.
Figure 6B:
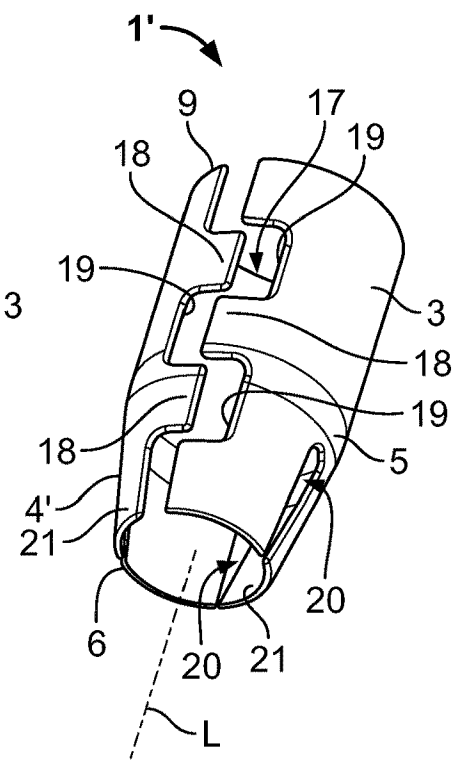
FIG. 6*b* is a schematic perspective view of another embodiment of a bushing according to the present invention.
Figure 6A:
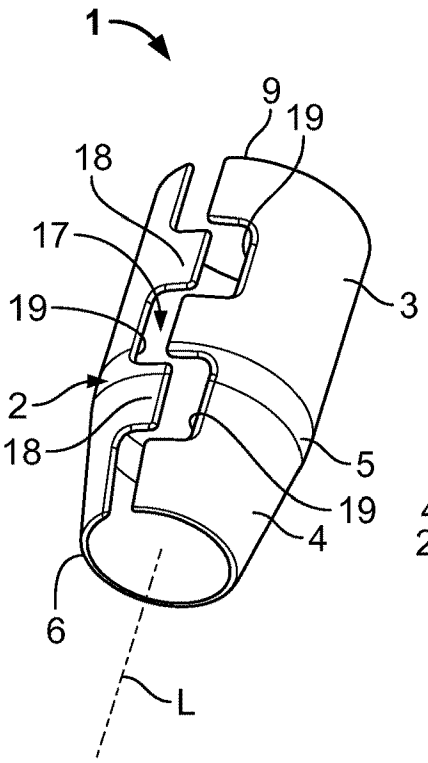
FIG. 6*a* is a schematic perspective view of the bushing shown in FIGS. 1 to 5.

Moreover, the bushings 1' and 1''' shown in FIGS. 6*b* and 6*d*, respectively, are provided with notches 20 opening in the forward direction F each. In the bushings 1' and 1''' have conical portions 4' differing from those of the bushings 1 and 1". The conical portions 4' by the formation of the slits 17, 17' and/or notches 20' are formed such that they comprise tongues 21 which extend towards the forward direction. The tongues 21 enhance the elasticity and spring characteristics of the conical portions 4'.

Deviations from the above-described embodiments of the present invention are possible without departing from the inventive idea. The bushing 1, 1', 1", 1''' may have a body with a conical portion 4, 4' shaped as desired for facilitating an insertion into a braid opening 106. Hence, the cylindrical portion 3 is not mandatory, but improves a gentle and even transfer of spring forces radially exerted onto the inner circumference 108 of the braid 104 by the outer circumference 16. Hence, also the transition region 5 may be omitted but it should be understood that the transition region 5 also enhances a smooth introduction of the bushing 1, 1', 1", 1''' into the braid 104.

The slit 17, 17' may be formed as desired for enabling elastical compression of the bushing 1, 1', 1", 1'''. The forward end 6 and the rearward end 9 may be provided with additional notches 20 and/or tongues 21 in whatever form and shape appropriate for providing additional elasticity.

The line 100 may be provided with a number of strands 101 with electrical conductors 102, inner electrical insulations 103, braids 104, outer insulations 113, sheaths, armour, reinforcement structures and/or optical fibres in whatever number, form and shape desired by the specific application. Also the ferrule 200 may be provided with a collar 201, a tapered portion 202 and/or a narrow portion 203 in order to form a front opening 204, receptacle 206 and inner circumference 207 in whatever form and shape appropriate for accommodating the bushing 1, 1', 1", 1''' and in order to be accommodated within a connector 300 and/or an enclosure assembly 400.

The connector 300 may comprise terminals 301, housings 302, housing parts 302*a*, 302*b*, holders 303, stops 304, necks 305 and bevels 307 in whatever number, form and shape desired in order to enclose the bushing 1, 1', 1", 1''', the line 100, the ferrule 200 and the connector 300.

It is, however, in each case advantageous if all conical portions 4, 4', widened sections 112, tapered portions 202 and bevels 307 are formed and arranged complementary and concentrically, by e.g. having annular, tapering, beveled and/or conical, preferably overlapping shapes engaging each other, such that the bushing 1, 1', 1", 1''', the line 100, the ferrule 200, the connector 300, the enclosure assembly 400 and/or the connector assembly 500 are easily brought into alignment and adjusted to each other.

What is claimed is:

1. A shielded connector, comprising:

a bushing for contacting an armour or braid of a cable or line, the bushing is essentially tapering in an insertion direction in which the bushing is adapted to be inserted into the armour or braid in order to be encompassed thereby, wherein the bushing has a radial elasticity allowing a spring tensioned widening and/or compression of the bushing, wherein at least one slit is provided extending along the insertion direction, and wherein at least one protrusion and at least one recess accommodating the protrusion are formed at the slit and extend along a circumferential direction of the bushing, the width of the recess being wider than the protrusion at each position of the protrusion within the recess, wherein the width of the slit can be expanded or reduced with the at least one protrusion being freely movable into and out of the recess along the circumferential direction of the bushing, to vary the circumference of the bushing while edges of the slit are radially aligned, the bushing having a smooth outer surface, with no part of the bushing extending beyond a circumference of the outer surface;

a connector positioned at least partly over the bushing; and a ferrule positioned over the bushing and the connector.

2. The shielded connector according to claim 1, wherein the slit extends along an entire length of the bushing in the insertion direction.

3. The shielded connector according to claim 1, wherein several protrusions and recesses opposing and/or complementing each other are formed along the at least one slit.

4. The shielded connector according to claim 1, wherein a tip of the bushing facing into the insertion direction comprising at least one notch extending essentially in parallel to the insertion direction.

5. The shielded connector according to claim 1, wherein at least one end of the bushing is formed as several tongues extending essentially in parallel to the insertion direction.

6. The shielded connector according to claim 5, wherein the tongues are arranged radially around a longitudinal axis of the bushing in a projection along the longitudinal axis which extends essentially in parallel to the insertion direction.

7. The shielded connector according to claim 1, wherein the bushing comprises a cylindrical portion and a conical portion.

8. The shielded connector according to claim 1, wherein the bushing is formed of a resilient metal or metal alloy.

9. The shielded connector according to claim 1, wherein the bushing is integrally formed of stamped sheet material.

10. The shielded connector according to claim 1, wherein the bushing is in a radially compressed state wherein a diameter of the bushing is reduced in comparison with an uncompressed state of the bushing.

11. The shielded connector according to claim 1, wherein the connector is inserted into and in a radial direction overlaps with at least one of a braid of a line and/or a shielding structure.

12. The bushing according to claim 1, wherein the bushing having a smooth inner surface being free of inward projections beyond a circumference of the inner surface.

13. The bushing according to claim 1, wherein a length of the bushing is greater than a width of the bushing.

14. The bushing according to claim 13, wherein the length of the bushing is at least four times the width of the protrusion.

15. A shielded connector, comprising:

a bushing for contacting a braid of a cable, the bushing comprising:

an elongate body having a cylindrically shaped portion and a tapered portion extending forwardly therefrom tapering in an insertion direction of the bushing, the elongate body having a smooth outer surface, where the body includes no outward projections that extend beyond a circumference of the outer surface;

at least one slit is provided extending along the insertion direction, and extending an entire length of the bushing;

at least one recess extending inwardly from a first edge of the slit in the cylindrically shaped portion and at least one recess extending inwardly from the first edge of the slit in the tapered portion;

at least one protrusion extending outwardly from a second edge of the slit in the cylindrically shaped portion and at least one protrusion extending outwardly from the edge of the slit in the tapered portion, wherein the protrusions extend along a circumferential direction of the bushing and into the recesses to overlap the slit;

the elongate body having a radial elasticity allowing a spring tensioned widening and/or compression of the bushing; and the width of the recesses being wider than the protrusions at each position of the protrusions within the recesses, wherein the width of the slit can be expanded or reduced with the at least one protrusion being freely movable into and out of the recess along the circumferential direction of the bushing, to vary the circumference of the bushing while edges of the slit are radially aligned;

a connector positioned at least partly over the bushing; and a ferrule positioned over the bushing and the connector.

16. The shielded connector according to claim 15, wherein the elongate body having a smooth inner surface being free of inward projections beyond a circumference of the inner surface.

17. The shielded connector according to claim 15, wherein a length of the bushing is greater than a width of the bushing.

18. The shielded connector according to claim 17, wherein the length of the bushing is at least four times the width of the protrusion.

19. A shielded cable assembly, comprising:

a shielded cable having an outer shielding braid and at least one inner conductor extending through the outer shielding braid;

a bushing inserted under the braid, the bushing comprising:

an elongate body having a cylindrically shaped portion and a tapered portion extending forwardly therefrom tapering in an insertion direction of the bushing;

at least one slit is provided extending along the insertion direction, and extending a length of the bushing;

at least one recess extending inwardly from a first edge of the slit in the cylindrically shaped portion and at least one recess extending inwardly from the first edge of the slit in the tapered portion;

at least one protrusion extending outwardly from a second edge of the slit in the cylindrically shaped portion and at least one protrusion extending outwardly from the second edge of the slit in the tapered portion, wherein the protrusions extend along a circumferential direction of the bushing and into the recesses to overlap the slit;

the elongate body having a radial elasticity allowing a spring tensioned widening and/or compression of the bushing;

the width of the recesses being wider than the protrusions at each position of the protrusions within the recesses, wherein the width of the slit can be expanded or reduced with the at least one protrusion being freely movable into and out of the recess along the circumferential direction of the bushing, to vary the circumference of the bushing while edges of the slit are radially aligned; and a connector positioned at least partly over the bushing, with the at least one conductor positioned within the connector; and a ferrule positioned over the bushing and the connector.

20. The shielded cable assembly according to claim 19, wherein the elongate body having a smooth outer surface being free of outward projections beyond a circumference of the outer surface.

21. The shielded cable assembly according to claim 20, wherein the elongate body having a smooth inner surface being free of inward projections beyond a circumference of the inner surface.

22. The shielded cable assembly according to claim 19, wherein a length of the bushing is greater than a width of the bushing.

23. The shielded cable assembly according to claim 19, wherein the length of the bushing is at least four times the width of the protrusion.

24. The shielded cable assembly according to claim 19, wherein a tip of the bushing facing into the insertion direction comprising at least one notch extending essentially in parallel to the insertion direction.

25. The shielded cable assembly according to claim 19, wherein at least one end of the bushing is formed as several tongues extending essentially in parallel to the insertion direction.

26. The shielded cable assembly according to claim 25, wherein the tongues are arranged radially around a longitudinal axis of the bushing in a projection along the longitudinal axis which extends essentially in parallel to the insertion direction.

27. The shielded cable assembly according to claim 19, wherein the bushing comprises a cylindrical portion and a conical portion.

28. The shielded cable assembly according to claim 19, wherein the bushing is formed of a resilient metal or metal alloy.

29. The shielded cable assembly according to claim 19, wherein the bushing is integrally formed of stamped sheet material.

* * * * *